US007076987B2

(12) United States Patent
Martin et al.

(10) Patent No.: US 7,076,987 B2
(45) Date of Patent: Jul. 18, 2006

(54) METHOD OF PRODUCING TAPERED OR POINTED CANNULA

(75) Inventors: Frank E. Martin, Durham, NC (US); M. Ishaq Haider, Morrisville, NC (US); Marcelino Munoz, Nogales, AZ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 2 days.

(21) Appl. No.: 10/912,308

(22) Filed: Aug. 5, 2004

(65) Prior Publication Data

US 2006/0027009 A1 Feb. 9, 2006

(51) Int. Cl.
*B21D 37/16* (2006.01)

(52) U.S. Cl. ..... 72/342.94; 72/342.1; 72/302; 219/59.1; 225/2; 604/264

(58) Field of Classification Search ..... 72/342.1, 72/342.94, 342.96, 378, 302; 219/643, 59.1, 219/61.4, 67, 68; 225/1, 2, 3; 604/164.06, 604/164.11, 239, 264, 272; 606/223
See application file for complete search history.

(56) References Cited

U.S. PATENT DOCUMENTS

| | | | | |
|---|---|---|---|---|
| 3,035,148 | A | 5/1962 | Oakley | |
| 3,218,136 | A * | 11/1965 | Hogan et al. | 411/498 |
| 3,434,329 | A | 3/1969 | Goble | |
| 3,540,447 | A | 11/1970 | Howe | |
| 3,735,463 | A | 5/1973 | Merola | |
| 3,906,932 | A | 9/1975 | Ayres | |
| 4,413,993 | A | 11/1983 | Guttman | |
| 4,455,858 | A | 6/1984 | Hettich | |
| 4,548,251 | A | 10/1985 | Lange | |
| 4,785,868 | A | 11/1988 | Koenig | |
| 4,846,392 | A | 7/1989 | Hinshaw | |
| 4,856,703 | A | 8/1989 | Uhlmann | |
| 4,885,945 | A | 12/1989 | Chiodo | |
| 4,916,278 | A * | 4/1990 | Rudd et al. | 219/602 |
| 5,224,638 | A * | 7/1993 | Nolan et al. | 225/2 |
| 5,445,001 | A | 8/1995 | Snavely | |
| 5,477,604 | A | 12/1995 | Smith et al. | |
| 5,484,417 | A | 1/1996 | Waitz et al. | |
| 5,515,871 | A | 5/1996 | Bittner et al. | |
| 5,688,246 | A | 11/1997 | Waitz et al. | |
| 5,928,207 | A | 7/1999 | Pisano et al. | |
| 6,234,913 | B1 * | 5/2001 | Bomcke | 470/34 |

(Continued)

FOREIGN PATENT DOCUMENTS

BE 900123 7/1984

(Continued)

OTHER PUBLICATIONS

Brochure from Jouhsen Bundgens, Apr. 2002, Germany.

(Continued)

*Primary Examiner*—Ed Tolan

(57) ABSTRACT

A method of producing a tubular device is provided. The method comprises providing a tubular stock having an axial passage, heating the tubular stock at a first heating location to form a softened section, the softened section separating a workpiece portion of the tubular stock from a remaining portion of the tubular stock, and drawing the workpiece portion away from the remaining portion to elongate the softened section and separate the workpiece portion from the remaining portion to form the tubular device. The drawing is performed at a rate such that the tubular device has an axial passage having a substantially uniform inside diameter, and an end of the tubular device formed from the elongated softened section is tapered.

23 Claims, 8 Drawing Sheets

U.S. PATENT DOCUMENTS

| | | | | |
|---|---|---|---|---|
| 6,334,856 | B1 | 1/2002 | Allen et al. | |
| 6,914,212 | B1 * | 7/2005 | Adams | 219/121.6 |
| 2003/0186625 | A1 | 10/2003 | Nakayama et al. | |

FOREIGN PATENT DOCUMENTS

| | | | |
|---|---|---|---|
| DE | 2061949 | A1 | 6/1972 |
| DE | 7221802 | U | 9/1972 |
| EP | 1287847 | A1 | 3/2003 |
| EP | 1374935 | | 1/2004 |
| FR | 979200 | | 4/1951 |
| WO | WO 02/100474 | A2 | 12/2002 |

OTHER PUBLICATIONS

IBM Technical Brochure, Sep. 1965, p. 633, USA.

* cited by examiner

METHOD OF PRODUCING TAPERED OR POINTED CANNULA

RELATED APPLICATIONS

This application is also related to U.S. application Ser. No. 10/912,439 filed concurrently on Aug. 5, 2004.

FIELD OF THE INVENTION

The invention relates to needles or other small tubes having a reduced outer diameter or tapered tip. The invention also relates to methods of making such needles or small tubes. More particularly, the invention relates to tapered, beveled cannula and methods of making them.

BACKGROUND OF THE INVENTION

Conventional needles have long been used to deliver drugs and other substances to humans and animals through the skin. The skin is made up of several layers, with a series of upper composite layers residing in the epidermis. The outermost layer of the epidermis is the stratum corneum, which has well known barrier properties to prevent molecules and various substances from entering the body and analytes from exiting the body. The stratum corneum is a complex structure of compacted keratinized cell remnants having a thickness of about 10–30 μm. The stratum corneum forms a waterproof membrane to protect the body from invasion by various substances and the outward migration of various compounds. This natural impermeability of the stratum corneum prevents the administration of most pharmaceutical agents and other substances through the skin. Following the stratum corneum, a further series of additional layers support the stratum corneum and comprise the rest of the epidermis. All of these layers together with the stratum corneum extend to a depth of between about 50 and 100 μm. The dermis follows the epidermis beginning at a depth of about 50–120 μm below the skin surface in humans and is approximately 1–2 mm thick. The dermis contains small capillaries and the beginnings of the nerve bed. Below the epidermis and dermis, the outer layers of the skin, lay the hyperdermis, fat layers and muscles with connective tissues.

Currently, the vast majority of medicaments that enter the body from without are injected through the skin into these regions underlying the epidermis and dermis, through both the Intramuscular (IM) and subcutaneous (SC) injection routes, directly into these tissues. In both of these typical injections routes, a needle penetrates through the various layers of the skin to the areas below the skin and the medicament is introduced through injection. The needles used for such injections are typically large gauge needles. Various advances in needle design over the years have allowed for the use of needles with sharper tips and, in some cases, smaller diameters in an attempt to mitigate the pain and damage to surrounding tissues caused by these injection routes. However, a great deal of discomfort and pain associated with the IM and SC delivery routes remains.

Numerous methods and devices have been proposed to introduce medicaments through the outer layers of the skin to avoid the intrusive, painful IM and SC delivery routes. The methods and apparatus for using this delivery route generally either increase the permeability of the skin by abrasion or increase the force or energy used to direct the drug through the skin. An example of such a device is a microabrader, which makes microscopic cuts in the skin to enhance permeability and, thereby, allows the medicaments to penetrate into the body without the need for injection. These devices typically utilize a plurality of microscopic blades or needles to abrade the stratum corneum. However, the technology to produce the microscopic blades or protrusions is still in its early development. Although there are several ongoing attempts to develop commercially effective ways of forming the microscopic blades, significant progress still needs to be made, especially in the area of microcannulas, in particular steel microcannulas.

Another route for introducing some types of medicaments into the body through the upper layers of the skin in a relatively painless and unobtrusive manner is by injection between the epidermal and dermal layers, the so-called intradermal (ID) injection. Recent advances in drug delivery systems and smaller gauge, microcannula have made the ID injection route a viable and promising alternative to the IM and SC injection routes for the delivery of some medicaments. ID administration and removal of drugs and other substances has several advantages over the traditional injection routes. The intradermal space is close to the capillary bed and allows for absorption and systemic distribution of the substances. In addition, there are more suitable and accessible ID injection sites available for a patient as compared to currently recommended SC administration sites.

Although attempts have been made to use the large gauge needles used in IM and SC injections to target delivery or extraction in the ID injection site, these attempts have generally been ineffective and inefficient. Using large gauge needles to target the ID delivery site requires special injection techniques, which are difficult to perform even if a trained professional is administering the injection. These techniques typically require the professional to maneuver the large gauge needle to the intradermal target site manually. This is prohibitively difficult as the ID injections occur in such a small target site just beneath the epidermis in the interface with the dermis. These larger gauge needles are often themselves larger in diameter than the target site. As a result, pain of insertion and the possibility of missing the target makes these systems and techniques impracticable.

However, the aforementioned advances in smaller gauge cannula technology have made the ID injection route a more plausible alternative. Of particular interest for the ID injection route are microneedles or microcannulas, which are typically less than 0.3 mm in mean diameter and less than 2 mm in length. They may be used in a variety of devices, including pen injection devices, arrays of multiple microneedles, micro pumps, and other medical devices. Microcannula benefit from the aforementioned design advances, having very sharp and short tips. The sharpness reduces the penetration force and discomfort felt by the patient resulting from the initial stick. The smaller diameter and sharper cannulas also reduce tissue damage and therefore decrease the amount of inflammatory mediators released during the ID injection. The short tip of the microcannula also facilitates drug delivery near the surface of the skin, without any fluid leakage. The size of the microcannula also allows for accurate targeting of the intradermal space, thus avoiding the need for the special insertion procedures that are currently used to reach this injection site with large gauge needles. The heretofore known microcannula are usually fabricated from silicon, plastic or, sometimes, metal and may be hollow for delivery or sampling of substances through a lumen.

A limiting factor in improving these drug delivery technologies has been the cost of forming and finishing both the improved, sharper large gauge cannula and the smaller gauge microcannula. In the typical production of large gauge cannula, significant costs are associated with forming and finishing the needles. Examples of this typical process are seen in U.S. Pat. No. 4,413,993 to Guttman, U.S. Pat. No. 4,455,858 to Hettich and 4,785,868 to Koeing Jr. The typical process begins with a flat stainless steel strip or blank. The steel strip is rolled and welded into a large gauge hollow tube. The large gauge tube is progressively drawn or otherwise cold worked down to achieve smaller gauge stock tubing, as shown in the aforementioned patents. This cold working simultaneously work hardens the tube. For instance, in both Hettich and Koeing the stock is stamped in a die, which work hardens the resulting cannula. The stock is then cut to length, forming cannula, which are then finished by conventional finishing means to provide a desired tip shape, typically a sharpened beveled tip. Even though improved finishing techniques, like those related by U.S. Pat. No. 5,515,871 to Bittner et. al. utilizing laser cutting, may be slightly more efficient than conventional techniques, the costs associated with finishing are still significant. Typically any additional finishing after the cannula is formed adds costs to the cannula as a result of, for example, increased production time, added machinery costs, and added variances in quality.

Although cutting methods for wire utilizing a heated zone and were known as early as 1965, as related in IBM Technical Disclosure Bulletin, September 1965, page 633, and more specifically, in German patent DE7221802 to Bündgens, directed to such a wire cutting apparatus. The IBM TDB only suggests giving a wire a "bullet nose" for threading proposes, and the Bündgens patent only suggests separation of wire or tubing into unitized portions and further processing of the unitized portions into needles, pins or the like. The further processes in secondary operations, as discussed previously, are at additional expense and processing time.

These costs are magnified as the cannula gauge is reduced. The processes described above are typically used for forming large gauge wires or conventional cannula and can be used commercially to produce cannula as small as 34 gauge. However, it is cost prohibitive to achieve finished needles at such a small gauge. Additionally, significant quality control problems arise from the application of conventional finishing techniques to these small gauge needles, including burring that clogs the hollow cannula and causes unwanted aberrations in the finished points.

Unlike the large gauge cannula, no cost-effective manner of mass production has been found to date for microcannula, especially durable steel or other metallic microcannula, smaller than 34 gauge. Although several attempts have been made at fabricating smaller microcannula, they have not been commercially successful. Moreover, the lack of a cost effective fabrication process for microcannula, especially durable steel microcannula, hampers development of devices capable of targeting the preferred ID injection site.

The heretofore known methods of mass-producing microcannula smaller than 34 gauge have been based predominantly on silicon microfabrication processes, such as etching, vapor deposition or masking. The current silicon, glass and plastic microcannula produced by these methods lack the durability necessary for effective use in ID injection devices. Devices such as those seen, for example, in the papers entitled *Transdermal Protein Delivery Using Microfabricated Microneedles* (Georgia Institute of Technology, S. Kaushik et al., October/November 1999), *Microfabricated Microneedles: A novel Approach to Transdermal Drug Delivery*, Sebastien Henry et al., Journal of Pharmaceutical Sciences, Volume 87, pgs. 922–925; and *Solid and Hollow Microneedles for Transdermal Protein Delivery*, Proceed. Int'l Symp. Control. Rel. Bioact. Mat., 26(Revised July 1999), pgs. 192–193), or as seen in U.S. Pat. Nos. 5,801,057, U.S. Pat. No. 5,879,326 and International Patent Application WO 96/17648 utilize silicon etching and other standard microprocessor manufacturing technologies to produce hollow cannula. Utilization of such manufacturing techniques is costly and provides cannulas with only limited durability, as silicon microcannula are brittle and subject to fracture during use.

Various other manufacturing processes have been applied to plastic and glass microcannulas, see for example U.S. Pat. No. 5,688,247 to Waitz et al and U.S. Pat. No. 4,885,945 to Chiodo, which show plastic and glass devices with tapered, beveled and closed plastic and glass tips. These devices are similarly not suitable for use in injections as they are fragile or not rigid enough to accurately target the ID injection site.

There remain no enabling technologies, to date, to make commercially viable microcannulas available in gauges smaller than 34 gauge, especially from steel or other durable metals. Further, there are no cost effective, commercially available steel microneedles or microneedles with conical, tapered or bevel shaped tips. Additionally, it would be desirable for a process to result in a near-net-shape unitized portion of cannula, such that it may be additionally processed with minimal effort into a finished small gauge cannula.

SUMMARY OF THE INVENTION

As the heretofore known devices and methods of manufacture and methods of using cannulas and microcannulas have exhibited limited or no commercial success, a continuing need exists in the industry for cannulas, devices, microdevices, microcannulas and especially methods of manufacture and methods of using cannulas and microcannulas that are both cost effective and functionally successful. Especially needed are methods for producing durable metal microcannulas in gauges smaller than 31 gauge (approximately 0.010 inches in diameter).

Certain aspects of the invention are directed to a method for producing a cannula or needle having a tapered tip with a smaller width than the width of the body portion of the cannula or needle. The terms needle and cannula are used interchangeably throughout the specification to describe a device having a body with an axial passage therethrough for injecting or removing fluids.

Other aspects of the invention include a method of forming a hollow cannula with a beveled end and having an axial passage extending through the cannula for delivering or withdrawing a substance through the skin of a patient. The cannulas are typically made from stainless steel, although other metal and non-metals can be used to form the cannulas.

Additionally, another aspect of the invention includes a method of forming a near-net-shape cannula blank, such that a minimal amount of additional processing is required to produce a finished cannula. The near-net-shape cannula blank is produced as a result of certain aspects of the method of the invention.

Particular embodiments of the invention provide a method of producing a tubular device. One method according to some aspects of the invention comprises providing a tubular stock having an axial passage, heating the tubular stock at a first heating location to form a softened section, the softened section separating a work piece portion of the tubular stock from a remaining portion of the tubular stock, and drawing the work piece portion away from the remaining portion to elongate the softened section and separate the work piece portion from the remaining portion to form the tubular device. The drawing is performed at a rate such that the tubular device has an axial passage having a substantially uniform inside diameter, and an end of the tubular device formed from the elongated softened section is tapered.

BRIEF DESCRIPTION OF THE DRAWINGS

Embodiments of the invention are explained greater detail by way of the drawing, where like numerals refer like elements, and wherein.

DETAILED DESCRIPTION OF THE PREFERRED EMBODIMENTS

Figure 1:
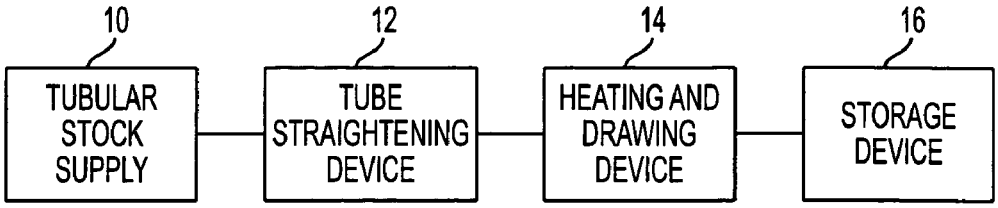
FIG. 1 is a schematic diagram of an apparatus for producing the cannula of certain aspects of the invention.

FIG. 1 is a schematic diagram of an apparatus for producing a cannula of certain aspects of the invention. Referring to the schematic diagram, a tubular stock material is fed from a supply 10. Supply 10 can be a spool or coil of tubular stock or it can be straight sections of tubular stock supplied in a manner that is known in the art. The stock material may additionally be fed to a tube straightening device 12 either upstream or downstream of the supply. Straightening device 12 can be a standard wire or tube straightening device as known in the art. Typically, tube straightening device 12 includes a series of rollers and guides capable of straightening the stock material into straight sections. Straightening device 12 can also be a cold working device or can include a suitable heating device to pre-heat the tubular stock material while being straightened or can include further heating and drawing processes and apparatuses. These devices reduce the gauge and straighten the tubular stock in preparation for it to be finally heated, drawn and cut into cannulas.

The straightened tubular stock is then fed to a heating and drawing device 14. Heating and drawing device 14 heats the tubular stock in a selected location and simultaneously draws the end of the tubular stock to reduce the diameter of the stock in the heated area. A heating element (described in more detail below) can be any suitable device capable of heating tubular stock to a sufficient temperature for drawing and forming the desired tip on the finished cannula. In one exemplary embodiment, the heating element is an induction coil or quartz heater. Other suitable examples of heating devices include controlled flames or ovens, high intensity light emitters or radiation sources or other suitable heating mechanisms that can provide controlled, localized heat. In some embodiments of the invention, it may be desirable to apply the heat on opposite sides of the tube at the same position along the longitudinal direction of the tube. These embodiments produce cannulas having tapered ends that are substantially uniform. In other embodiments of the invention, it may be desirable to apply heat at a point of application that is slightly offset in the longitudinal direction on opposite sides of the localized heating area. These embodiments produce cannulas having tapered ends that are beveled. Heating and drawing apparatus 14 draws the tubular stock material at a rate and distance to reduce the diameter of the tubular stock and separate the tubular stock along the heated area to form a cannula. In one embodiment of the invention, heating and drawing apparatus 14 is an automated apparatus for heating the tubular stock material to a predetermined temperature and for drawing the stock material at a controlled time sequence, rate and distance to obtain a cannula having a desired shape and dimension. The resulting tapered cannula is then fed to a storage device 16 for storing.

Figure 2:
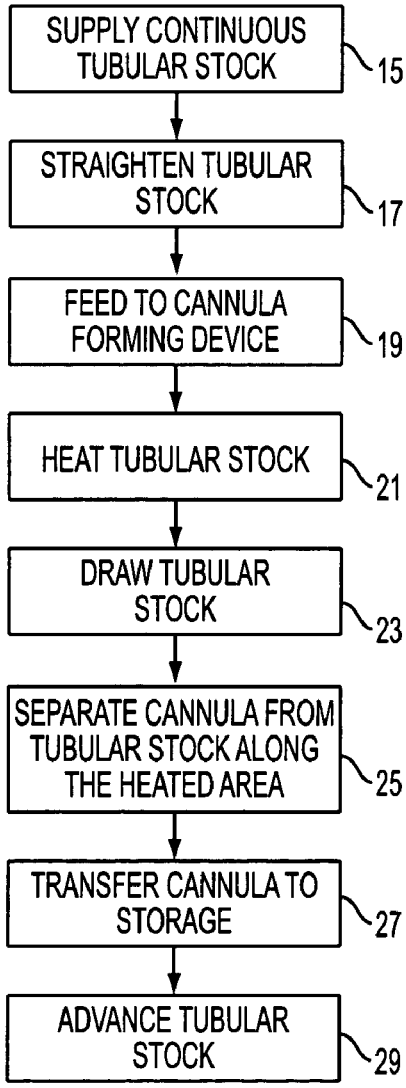
FIG. 2 is a flow-chart depicting the method steps for producing the cannula of certain aspects of the invention.

The method of making the cannulas of the invention is shown generally in the flow chart of FIG. 2. As depicted in FIG. 2, a supply of a tubular stock material is provided as indicated by block 15, and optionally straightened as indicated by block 17. As mentioned previously, straightening can include cold working and other methods of working the tubular stock, including processes for reducing the gauge of the tubular stock. The tubular stock is fed to the cannula forming device as indicated by block 19, heated (optionally at an offset) as indicated by block 21, and drawn as indicated by block 23. The resulting cannula is separated from the tubular stock along the heated area as indicated by block 25, providing a tapered cut in the cannula. The resulting tapered cannula is then transferred to a storage device indicated by block 27. After the cannula is separated from the tubular stock, the tubular stock is advanced as indicated by block 29 to repeat the process.

The heating and drawing of the tubular stock is preferably controlled such that the outer portion of the tube is stretched while the inner portion of the tube maintains more of its rigidity. In this way, a tapered end of the cannula is formed while the internal diameter of the cannula is substantially unchanged from that of the tubular stock prior to heating and drawing. If the inner portion (or wall) of the tubular stock is permitted to obtain too high of a temperature, the inner wall can collapse resulting in a decrease in internal diameter. Although some embodiments experience no decrease in internal diameter, a certain amount of decrease in internal diameter may be acceptable. Controlling the heating and pulling parameters can control the amount of decrease in internal diameter.

Referring to FIGS. 3–7, an exemplary embodiment of heating and drawing device 14 includes a base 18, a first clamp 20, a second clamp 22 and two feed devices 36, 44. Base 18 has a length and width to support a working length of tubular stock 24 for forming the finished cannulas. In the illustrated embodiment, first clamp 20 is connected to base 18 and includes a passage 26 to receive tubular stock 24. First clamp 20 can include a movable jaw that forms a clamping surface that retracts to allow tubular stock 24 to be fed through passage 26. The first clamp 20 may alternatively include movable rollers, grips or any other suitable mechanisms to apply sufficient forces to hold the tubular stock in place.

Second clamp 22 is coupled to base 18 and is movable in a linear direction with respect to first clamp 20. In the illustrated embodiment, second clamp 22 includes a passage 28 aligned with passage 26 of first clamp 20 and dimensioned to receive tubular stock 24. Second clamp 22 can also include a movable jaw or similar device for clamping tubular stock 24 in the second clamp 22. In this embodiment, second clamp 22 is movable along base 18 in the axial direction of passage 26, passage 28, and tubular stock 24.

Second clamp 22 is typically coupled to a drive mechanism for moving second clamp 22 with respect to base 18. In an exemplary embodiment, the drive mechanism is an electric motor. However, any suitable drive can be utilized. The drive mechanism can also be, for example, a hydraulic or pneumatic actuator or other mechanical actuator. First clamp 20 and second clamp 22 are operatively connected to a suitable control device, a mechanical cam for instance, which can be coupled to the drive. Alternatively, any suitable control device, such as a microprocessor or microcontroller may be used for synchronizing the drive, the clamping operation, the drawing operation and the feed operation of the feeding device. An example of an exemplary drive mechanism and drawing assembly is the wire drawing apparatus Model MJR0502 manufactured by Jouhsen-Budgens Maschinenbau GmbH, suitably modified for the purposes of this invention. Similarly, German patent DE72218020 relates to such a wire drawing apparatus.

Figure 3:
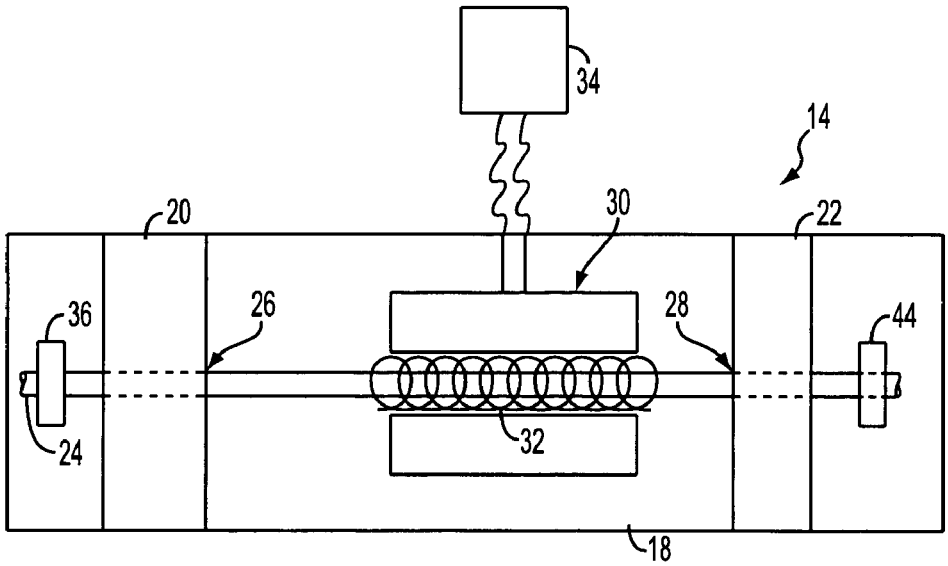
FIG. 3 is a top view of the apparatus for forming the cannulas in one embodiment showing the tubular stock clamped to the apparatus.
Figure 4:
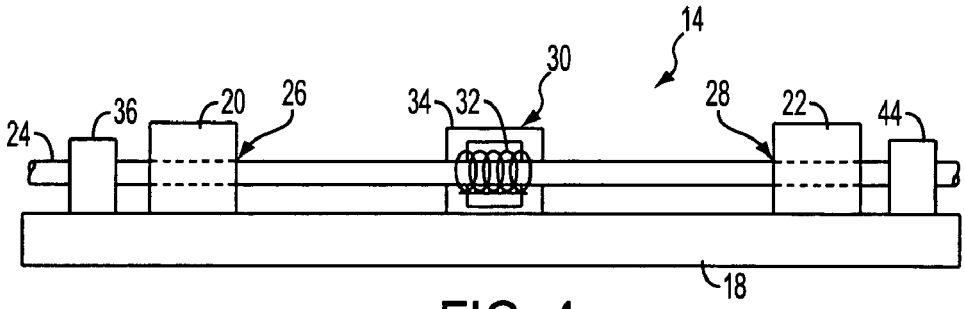
FIG. 4 is a side view of the apparatus of FIG. 3.

A heating device 30 shown in FIGS. 3 and 4 is mounted along the base 18. In particular embodiments, the heating device 30 can be mounted in a movable fashion. In other embodiments, a plurality of heating devices may be provided. In FIG. 3, heating device 30 includes a heating element 32 and a heating element control 34. As shown in FIG. 3, tubular stock 24 is surrounded by heating element 32, in a direction substantially parallel to the axis of tubular stock 24 when clamped in a working position. Alternatively, heating element 32 may be located so that it is in proximity to only selected portions of tubular stock 24. Heating element 32 can be any suitable device capable of heating tubular stock 24 to a sufficient temperature for drawing and forming the desired tip on the finished cannula. In one exemplary embodiment, heating element 32 is an induction coil or quartz heater. Other suitable examples of heating devices include controlled flames or ovens, high intensity light emitters or radiation sources or other suitable heating mechanisms that can provide controlled, localized heat. Control device 34 is mounted for activating heating element 32 to heat tubular stock 24 in the selected locations.

Figure 5:
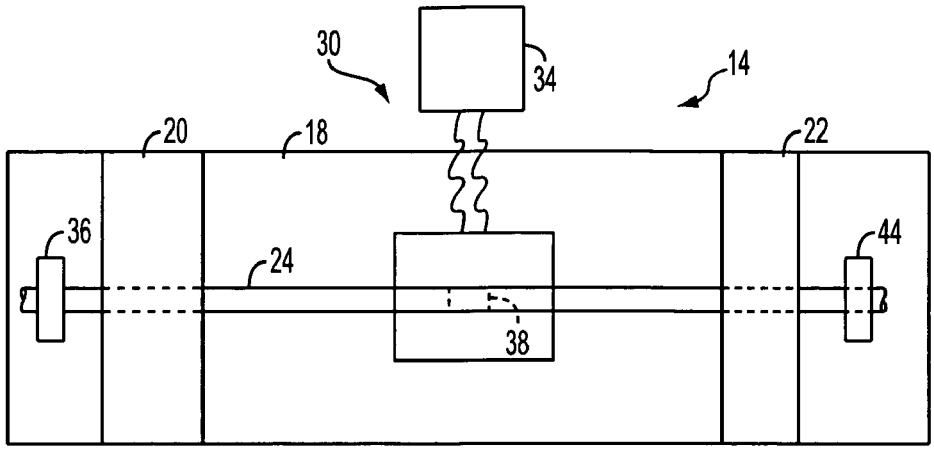
FIG. 5 is a top view of the apparatus of FIG. 3 showing the heating device in position to heat a localized area on the tubular stock.
Figure 6:
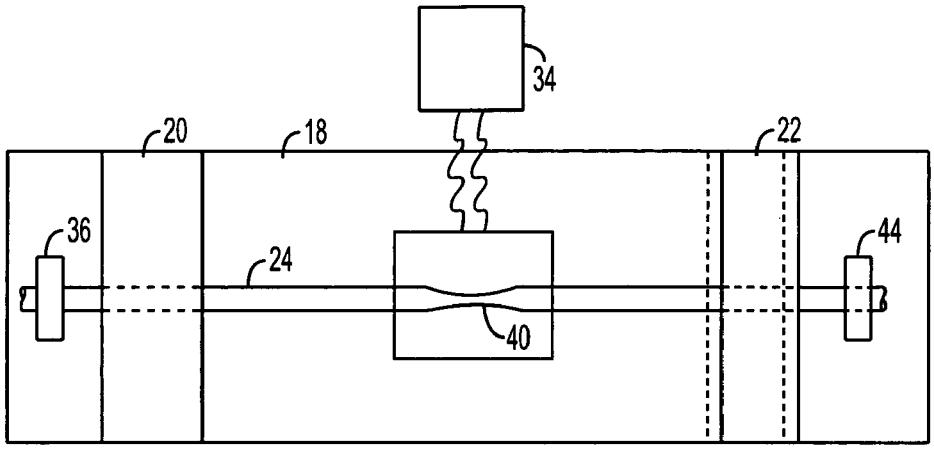
FIG. 6 is a top view of the apparatus of FIG. 3 showing the tubular stock being drawn to form a constricted area in the tubular stock.
Figure 7:
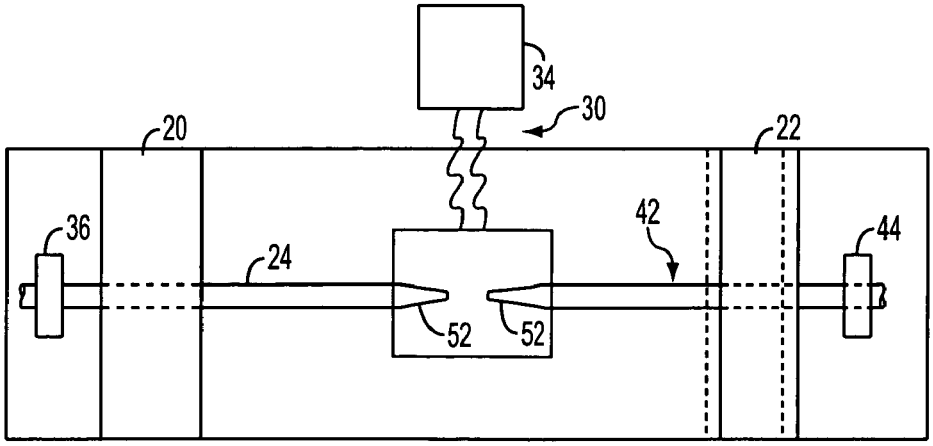
FIG. 7 is a top view of the apparatus of FIG. 3 showing the tubular stock severed along the localized heated area.

FIGS. 5–7 are top views of the apparatus shown in FIGS. 3 and 4. FIG. 5 shows a localized area 38 of tubular stock 24 in which the heating is focused. When localized area 38 reaches the appropriate temperature, second clamp 22 is moved in a direction (to the right in FIG. 6) that stretches tubular stock 24 to create stretched portion 40. As second clamp 22 continues to move, stretched portion 40 breaks and forms two tapered portions 52, as shown in FIG. 7. A cannula 42 is formed from the piece of tubular stock that is separated from tubular stock 24.

Figure 8:
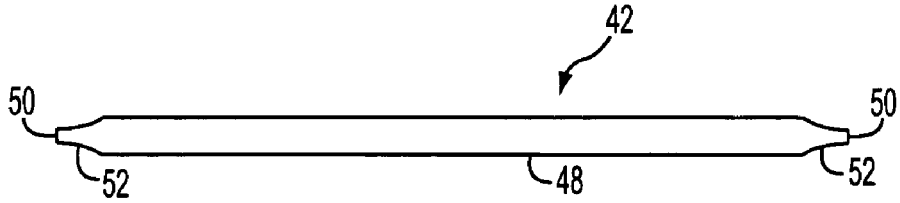
FIG. 8 is a side view of the cannula produced by the apparatus of FIG. 3.
Figure 9:
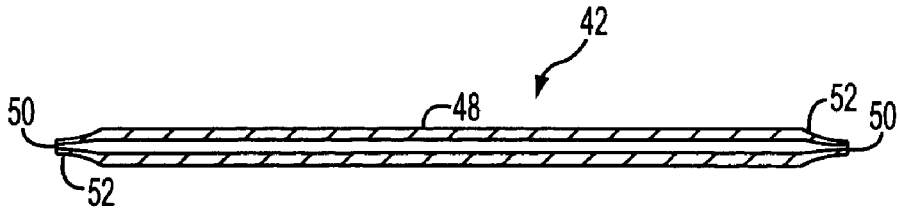
FIG. 9 is a sectional view of the cannula shown in FIG. 8.

FIGS. 8 and 9 show an example of cannula 42 formed by the device shown in FIGS. 3–7. Cannula 42 has a tubular section 48 that has inside and outside diameters substantially equal to those of tubular stock 24. At each end, cannula 42 has an opening 50 in tapered portion 52. FIG. 9 shows the inside diameter of openings 50 being smaller than the inside diameter of tubular section 48. However, other embodiments of the invention provide a cannula with opening 50 having an inside diameter equal to the inside diameter of tubular section 48. Embodiments having a uniform inside diameter are often preferred for delivering or withdrawing material through the cannula.

Figure 10:
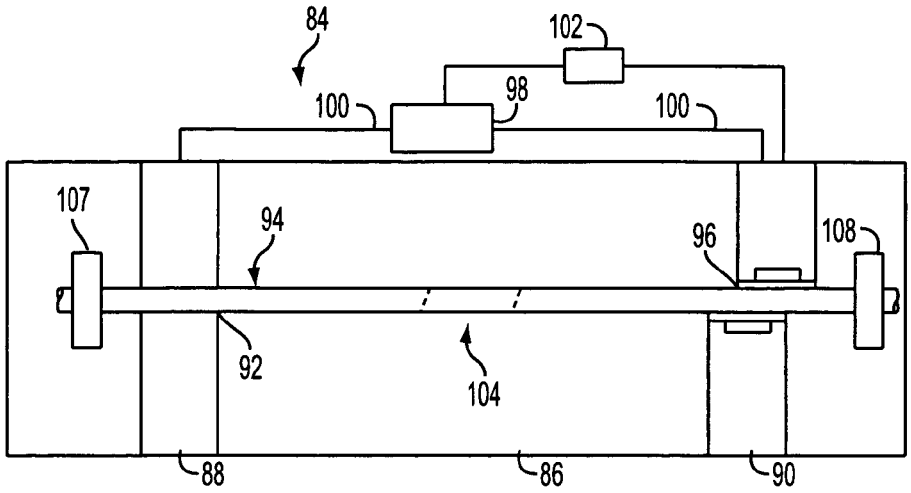
FIG. 10 is a side view of a second exemplary embodiment of the instant invention for producing cannula with a beveled tip.

FIGS. 10–13 show an embodiment for producing a cannula with a beveled tip. Referring to FIG. 10, apparatus 84 includes a base 86 having a fixed first clamp 88 and a movable second clamp 90. As in the previous embodiment, first clamp 88 has an axial passage 92 for receiving a tubular stock 94. Second clamp 90 also includes an axial passage 96 for receiving tubular stock 94. Second clamp 90 is movable in a linear direction away from first clamp 88 as in the previous embodiment. Feed devices 107, 108 feed tubular stock 94 through the apparatus at appropriate times.

As shown in FIGS. 10–13, an electric power source 98 is connected to electrodes 200, 220 of first clamp 88 and electrodes 210, 230 of second clamp 90 by conductors 100 to supply an electric current through tubular stock 94. A control device 102 is connected to electrical source 98 and to electrodes 200, 210, 220, 230 to control the current delivery through tubular stock 94 and the movement of second clamp 90.

Figure 11:
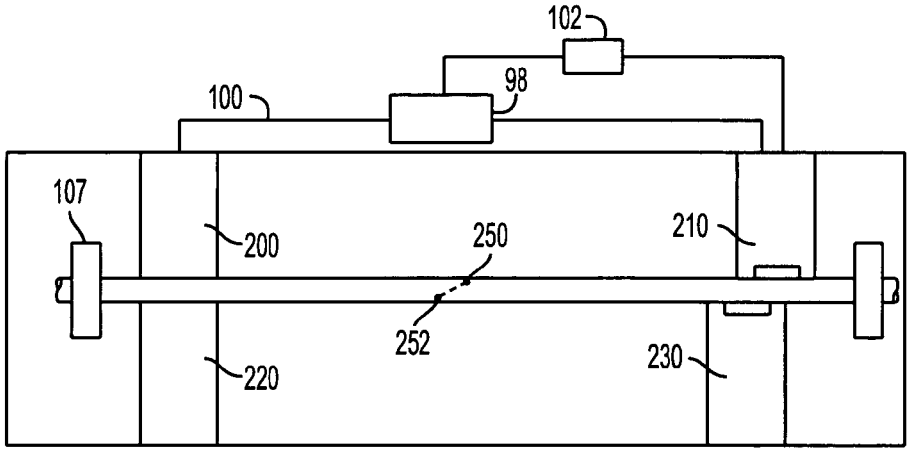
FIG. 11 is a side view of the second exemplary embodiment of FIG. 10 showing the offset heating of the localized heated area of the tubular stock.
Figure 12:
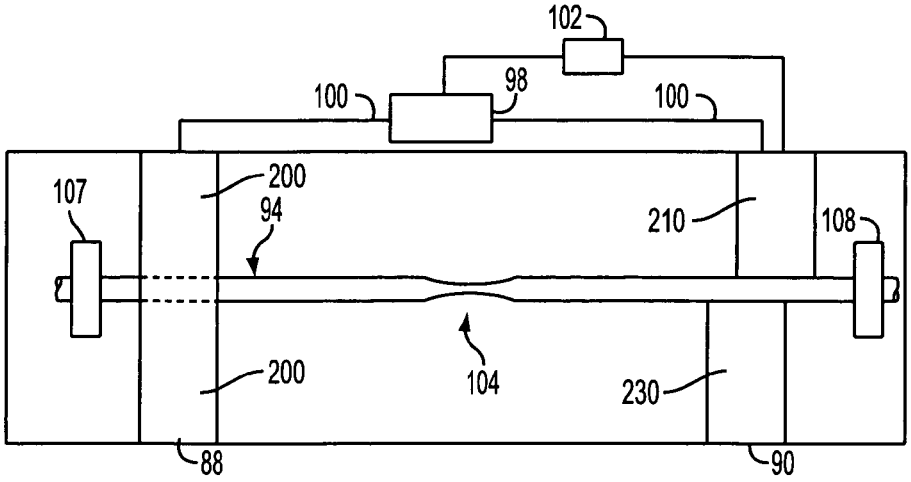
FIG. 12 is a side view of the second exemplary embodiment of FIG. 10 showing the stock material being drawn.

As shown in FIGS. 11 and 12, top electrode 210 of second clamp 90 is offset with respect to lower electrode 230 of second clamp 90. A beveled tip of the cannula is produced by offsetting at least one electrode, for example the single electrode 210, which in turn offsets a heating center point 250 on one side of tubular stock 94 from a heating center point 252 on the other side of tubular stock 94. Alternatively, both top electrodes 200 and 210 could be offset to achieve similar results. As second clamp 90 is moved away from first clamp 88, the heated area 104 begins to stretch and constrict. Continued drawing of tubular stock 94 by moving second clamp 90 away from first clamp 88 severs or fractures tubular stock 94 along the heated area 104 between the two center points 250, 252 as represented by the dashed line in FIG. 11.

Figure 13:
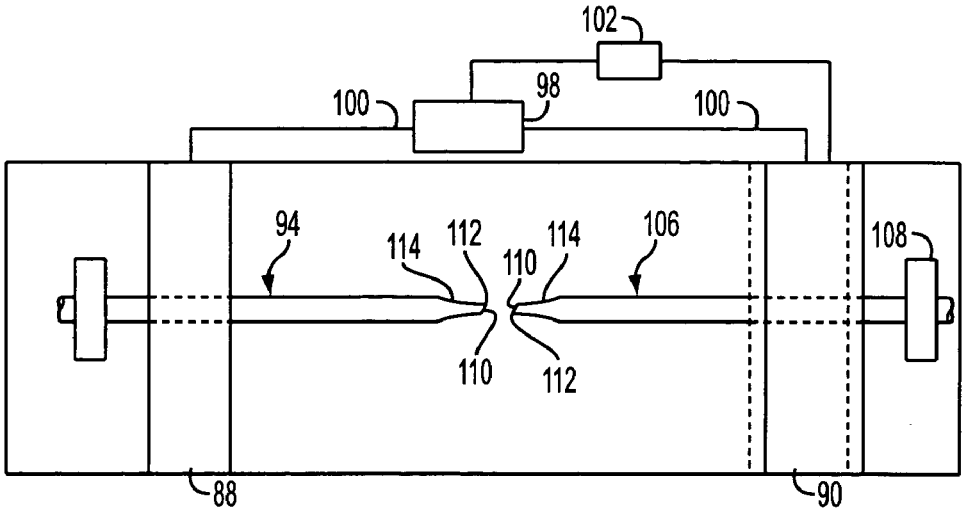
FIG. 13 is a side view the second exemplary embodiment of FIG. 10 showing the stock material being separated along the offset, beveled angle.

FIG. 13 is a view the embodiment shown in FIGS. 10–12 showing tubular stock 94 being separated. Due to the offset heating described above, the cannulas separate along a line connecting the center point of heating on one side of the tube with the corresponding center point of heating on the other side of the tube. By offsetting the center of heating, the drawing of the heated and softened portion causes tubular stock 94 to fracture along an inclined plane with respect to the axial direction of the draw. This separation of the center points of heating forms a beveled tip or beveled distal end when the tubular stock is drawn to fracture. This forms a cannula member 106. Cannula member 106 is then directed to a suitable storage device by feed device 108. Tubular stock 94 is then advanced through first clamp 88 and into second clamp 90 and the process is repeated.

Figure 14:
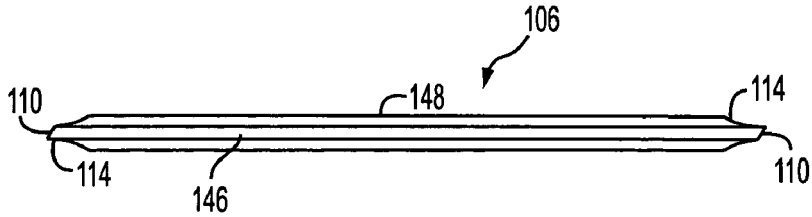
FIG. 14 is a side view of the beveled tapered cannula obtained from the second exemplary embodiment of FIG. 10.
Figure 15:
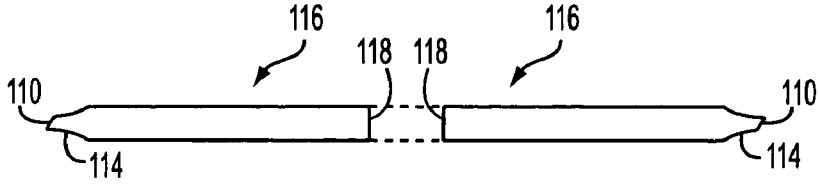
FIG. 15 is a side view of the beveled tapered cannula obtained from the second exemplary embodiment cut to form two cannulas.

The apparatus of the embodiment of FIGS. 10–13 produces a hollow cannula 106 as substantially shown in FIGS. 14 and 15. The resulting cannula 106 has an axial passage 146 having open beveled distal ends 110 and a substantially cylindrical shaped body portion 148. The embodiment shown has a tapered portion 114, which ends in open beveled distal end 110 and is generally frustoconical. Beveled distal ends 110 can be formed at almost any desired angle by altering the placement of heating center points 250, 252. Each beveled distal end 110 converges to a sharpened tip portion 112. Typically, each end of cannula 106 is drawn to form tapered portion 114 converging toward beveled distal ends 110. Further post-processing to form a sharpened beveled needle is thus minimized by certain aspects of the invention. However, further processing is possible. For instance, acid etching, laser cutting, grinding, polishing or the like may be performed to the end of the cannula to produce an even sharper tip.

The resulting cannula 106 shown in FIG. 14 can be used as a double tipped cannula or cut (as shown in FIG. 15) into two cannula sections 116 to form two cannulas with a single tapered, beveled end and straight cut end 118 opposite the beveled distal end 110. In the exemplary embodiments, tubular stock 94 is drawn to form a sharpened tip portion 112 having an axial length of about 0.5 to about 1.0 mm. In another exemplary embodiment, the sharpened tip portion 112 has an axial length corresponding to the desired depth of penetration of the resulting cannula into the skin of the patient. The total length of the cannulas typically ranges from about 5 to 10 mm. In the alternative, the draw and cut steps can include an additional cut step. Thus, a length of tubular stock 94 is fed, drawn and cut, then a further length of tubular stock is fed to the heating device and a straight cut performed without drawing or with very rapid drawing so as to snap tubular stock 94 without producing a tapered end. Single pointed cannula may therefore be continuously produced by certain aspects of the invention by alternating the drawing and cutting cycles on the same machine.

The temperature and size of the heated portion as well as the rate of draw and the distance of the draw affect the axial length of tapered portion 114. In one embodiment, second clamp 90 moves about 1.0 mm to draw tubular stock 94 to form the beveled tip and sever the tubular stock along the offset centers of heated portion 250,252.

The rate of the draw of tubular stock 94 is another of several variables that influences the final shape of tapered portion 114 and the axial length of the tip. Typically, a slower rate of draw enables tubular stock 94 to stretch and form an elongated hourglass shape before tubular stock 94 severs. The slower rate of draw generally produces a longer axial length of tapered portion 114. A faster rate of draw causes tubular stock 94 to sever before significant stretching can occur so that the resulting cannula has a tapered portion 114 with a shorter axial length than that obtained by a slower draw. The shorter the axial length of the tip, the less the reduction in diameter of the resulting cannula.

As mentioned previously, the timing of the draw of tubular stock 94 is coordinated with the heating of tubular stock 94. Generally, it is necessary to begin drawing tubular stock 94 while it is being heated to accommodate for the thermal expansion of the tubular stock 94. A rapid heating cycle without drawing can cause tubular stock 94 to expand between clamps 88 and 90 and buckle or distort. Tubular stock 94 is heated to a suitable temperature to soften the material and to allow the material to become malleable. The actual temperature can vary depending on the material. Generally, in an exemplary embodiment, tubular stock material 94 is a metal, such as stainless steel, and is heated to about the annealing temperature of the material. For example, if the tubular stock material is stainless steel, it is heated to a temperature of about 2000° F. However, severing of the cannula 106 can be accomplished at temperatures above or below the annealing temperatures for any given material. If the temperature at fracture is significantly lower than the annealing temperature, it provides a lower quality, rougher cut in the cannula 106. The melting point of the material is a limiting factor in the process as the material will not stretch but instead flow at this temperature.

In particular embodiments, the heating is performed such that an outer portion of tubular stock 94 at the softened portion reaches a maximum temperature higher than a maximum temperature reached by an inner portion of tubular stock 94 at the softened portion. In these and other embodiments, the heating and drawing are performed such that the outer portion of tubular stock 94 at the softened section stretches plastically immediately prior to the inner portion of tubular stock 94 at the softened section, breaking and separating the cannula from the remaining portion of the tubular stock.

The rate of heating is also dependent on the type of heating element used, the dimensions of tubular stock 94 and the desired length of the draw of tubular stock 94. In one exemplary embodiment, the tubular stock 94 is a 31 gauge stainless steel tubular stock and is heated and drawn in about 15 to 45 milliseconds. However, the process is not limited to smaller gauge cannula. This process can be applied to mass production of large gauge cannula. The drawing parameters and heating times can be easily adjusted to accommodate the thicker, longer tubular stock. Similarly, the invention can be adjusted to accommodate any appropriate heating device to manage heating such stock.

Figure 16:
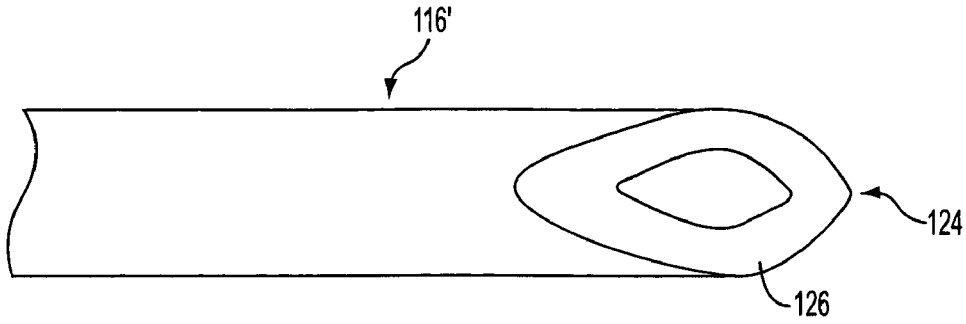
FIG. 16 is a partial bottom view of a cannula in accordance with another embodiment of the invention.
Figure 17:
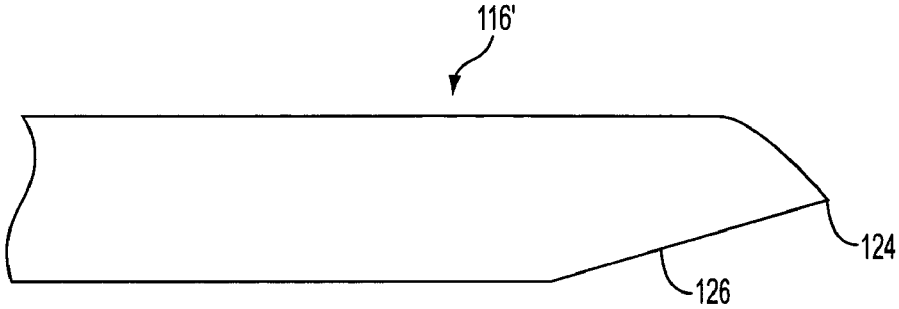
FIG. 17 is a partial side view of the cannula shown in FIG. 16.

FIGS. 16 and 17 show partial views of a tapered, beveled cannula 116' in accordance with the invention. Cannula 116' has a tip 124 and a fracture surface 126. Fracture surface 126 is formed when the tubular stock is fractured under the force of the drawing operation. FIGS. 16 and 17 illustrate a cannula having an internal diameter that is substantially unchanged from that of the tubular stock prior to drawing.

Figure 18:
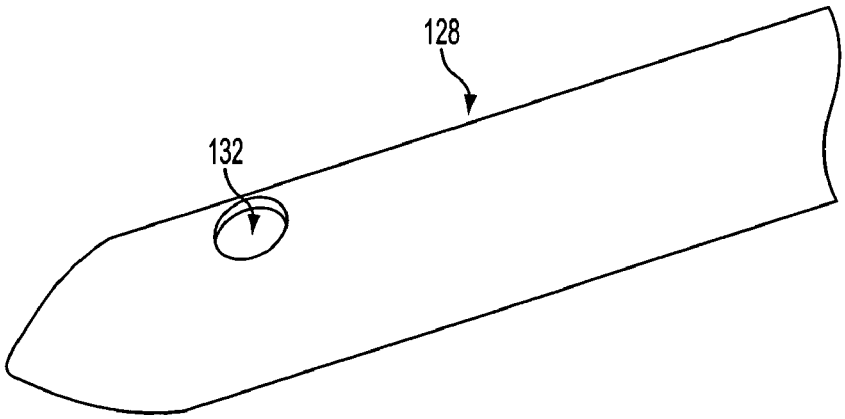
FIG. 18 is a perspective view of cannula in accordance with another embodiment of the invention.

FIG. 18 shows a cannula 128 that is provided with a hole 132 that aids in substance delivery by increasing the open area through which the substance can be delivered.

Figure 19:
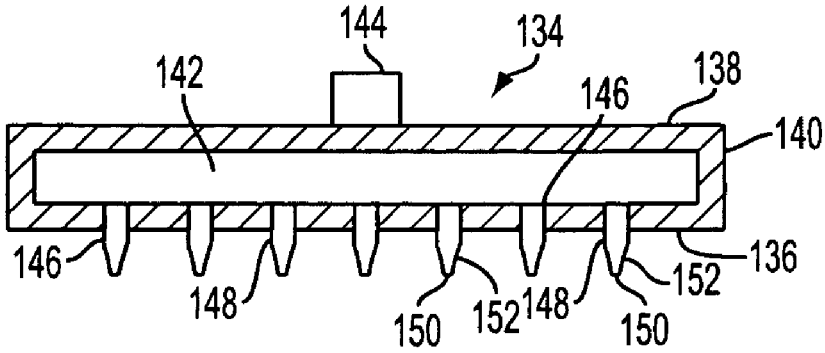
FIG. 19 is a side sectional view of a microdevice for delivering or withdrawing a substance through the skin of a patient.
Figure 20:
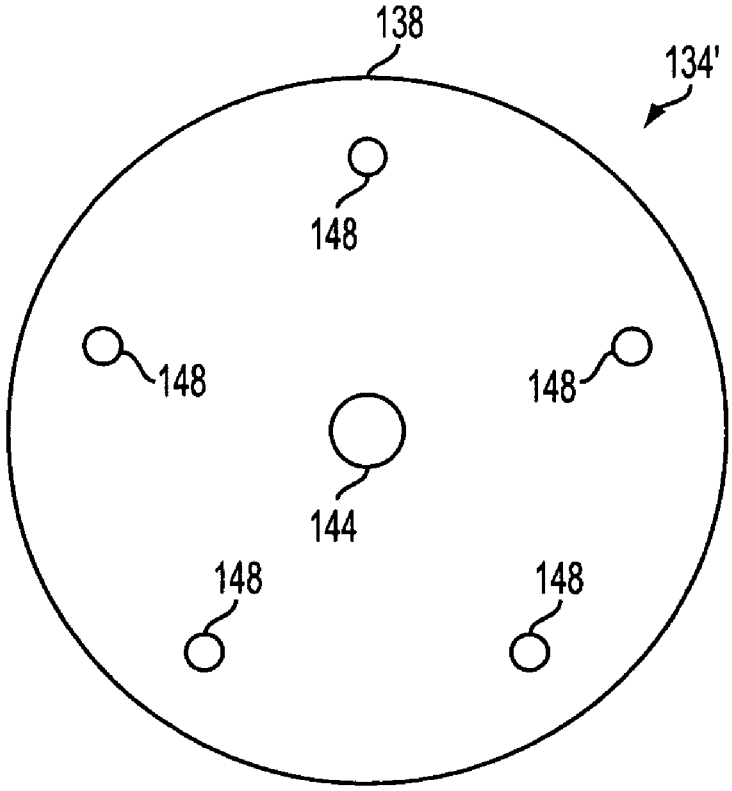
FIG. 20 is a bottom view of a microdevice for delivering or withdrawing a substance through the skin of a patient.

The finished cannulas of certain aspects of the invention preferably have a length ranging from about 0.5 mm to several millimeters. Typically, the cannulas have a length ranging from about 0.5 mm to about 5.0 mm. The cannulas are particularly suitable for assembling in fluid delivery devices such as devices 134, 134' shown in FIGS. 19 and 20. Devices 134 and 134' are examples of suitable devices for delivering a substance transdermally to a patient. Devices 134, 134' have a bottom wall 136, a top wall 138 and sidewalls 140 forming an internal chamber 142. A fluid inlet 144 communicates with chamber 142 for supplying a substance to be delivered to a patient. Fluid inlet 144 can be coupled to a syringe or other fluid delivery device. Bottom wall 136 includes a plurality of spaced apart apertures 146 for receiving a respective cannula 148. Cannulas 148 can be adhesively attached to bottom wall 136 or press fitted into apertures 146. Cannulas 148 communicate with chamber 142 for delivering the substance to the patient.

Cannulas 148 in the embodiments illustrated have a beveled surface 152 to form a sharpened tip 150. However, other embodiments use cannulas having different tip shapes. Cannulas 148 are typically arranged in the bottom wall 136 to form an array. The array can, for example, contain about 5 to about 50 spaced apart cannulas. Cannulas 148 generally have an effective length extending from bottom wall 136 of about 0.25 mm to about 2.0 mm, and preferably about 0.5 mm to about 1.0 mm. The actual length of the cannulas can vary depending on the substance being delivered and the desired delivery site on the patient. Devices 134, 134' are pressed against the skin of the patient to enable cannulas 148 to penetrate the surface of the skin to the desired depth. The substance to be delivered to the patient is then supplied to inlet 144 and directed through cannulas 148 into the skin where the substance can be absorbed and utilized by the body. In preferred embodiments, cannulas 148 have an effective length sufficient to penetrate the skin to a depth sufficient for delivery of the substance without causing excessive pain or discomfort to the patient.

In preferred embodiments of the invention, the cannulas are made from stainless steel tubing of a suitable gauge that can be heated and drawn to form a distal end with a reduced diameter. Other sized tubular stock may also be used to produce cannula of larger or smaller gauge. Other materials can also be used to form the cannulas. Examples of suitable metals include tungsten, steel, alloys of nickel, molybdenum, chromium, cobalt and titanium. In other embodiments, the cannulas can be formed from ceramic materials and other non-reactive materials.

EXAMPLE 1

An experiment according to the parameters of Table 1 was conducted using an electrostriction machine as described previously. Tubular stock with dimensions corresponding to 31 G tubing (approximately 0.26 mm outside diameter and approximately. 0.12 mm inside diameter) was fed to the machine. The tubular stock was then heated in a localized zone with the current and time indicated in the chart. The clamping pressure of the electrodes was approximately 1 Newton, and while the electrodes were clamped the stock was pulled for approximately 1 mm. The electrodes were offset from each other by the distance indicated. Resulting tip geometries are indicated by point lengths, which vary from approximately 0.30 mm to 0.80 mm, and tip diameters from 0.08 mm to 0.17 mm. Runs 1–3 in the table produced tips that have been tapered, without creating a beveled surface. Runs 4–5 produced tips with a bevel which had point length of about 0.7 to about 0.8 mm and a diameter which ranged from about 0.08 to about 0.17 mm in diameter. Since the inside diameter of the tubing is approximately 0.012 mm, runs 4–5 produced beveled tips.

TABLE 1

31G Cannula Tapered and Pointed with Electrostriction Process

| RUN # | Needle OD (mm) | Electrode Offset (mm) | Annealing Time (ms) | Current (Amperes) | Protective Gas | Point Length (mm) | Tip Outside Diameter (mm) |
|---|---|---|---|---|---|---|---|
| 1 | 0.26 | 1.5 | 30 | 31 | None | 0.30 | 0.150 |
| 2 | 0.26 | 1.5 | 30 | 35 | None | 0.40 | 0.123 |
| 3 | 0.26 | 2.0 | 15 | 35 | Argon | 0.50 | 0.120 |
| 4 | 0.26 | 2.5 | 15 | 35 | Argon | 0.70 | 0.090–0.170 |
| 5 | 0.26 | 3.0 | 15 | 35 | Argon | 0.80 | 0.080–0.100 |

EXAMPLE 2

An experiment according to the parameters of Table 2 was conducted using an electrostriction machine as described previously. Tubular stock with dimensions corresponding to 34G tubing (approximately 0.16 mm outside diameter and approximately 0.06 mm inside diameter) was fed to the machine. The tubular stock was then heated in a localized zone with the current and time indicated in the chart. Resulting tip geometries are indicated by point lengths, which vary from about 0.35 mm to about 0.80 mm, and tip diameters from 0.06 mm to 0.068 mm. Each run in the table produced tips that have been tapered, without creating a beveled surface.

TABLE 2

34G Cannula Tapered with Electrostriction process

| RUN # | Needle OD (mm) | Annealing Time (ms) | Current (Amperes) | Pro-tective Gas | Point Length (mm) | Tip Outside Diameter (mm) |
|---|---|---|---|---|---|---|
| 1 | 0.16 | 86 | 18 | Argon | 0.36 | 0.068 |
| 2 | 0.16 | 80 | 18 | None | 0.35 | 0.068 |
| 3 | 0.16 | 81 | 18 | Argon | 0.50 | 0.060 |
| 4 | 0.16 | 81 | 18 | Argon | 0.36 | 0.065 |

The embodiments and examples discussed herein are non-limiting examples. The invention is described in detail with respect to preferred embodiments, and it will now be apparent from the foregoing to those skilled in the art. Changes and modifications may be made without departing from the invention in its broader aspects, and the invention, therefore, is intended to cover all such changes and modifications that fall within the spirit of the invention.

What is claimed is:

1. A method of producing a pointed cannula, comprising:

providing a tubular stock having an axial passage;

heating the tubular stock at a first heating location to form a softened section, the softened section separating a workplace portion of the tubular stock from a remaining portion of the tubular stock;

heating the tubular stock at a second heating location, the second heating location being offset from the first heating location along a longitudinal direction of the tubular stock; and drawing the workpiece portion away from the remaining portion to elongate the softened section and separate the workpiece portion from the remaining portion to form the tubular device, wherein the drawing separates the workpiece portion from the remaining portion at a beveled angle of between about 10° to about 45° with respect to a longitudinal axis of the tubular stock.

2. The method of claim 1, wherein the heating is performed such that an outer portion of the tubular stock at the softened section reaches a maximum temperature higher than a maximum temperature reached by an inner portion of the tubular stock at the softened section.

3. The method of claim 1, wherein an end of the tubular device formed from the elongated softened section is tapered.

4. The method of claim 1, wherein the heating is performed by a device selected from the group consisting of a quartz heater, an induction coil, a microwave device, a radio frequency device, a controlled flame and an oven.

5. The method of claim 1, wherein the heating is performed by placing a heating member in contact with the tubular stock at the first heating location.

6. The method of claim 1, wherein the heating is performed by applying a first electric current through the tubular stock to heat the tubular stock at the first heating location.

7. The method of claim 6, wherein the heating is performed by applying a second electric current through the tubular stock to heat the tubular stock at the second heating location.

8. The method of claim 7, wherein the first electric current is applied to the tubular stock by first and second electrodes spaced a first distance apart, the second electric current is applied to the tubular stock by third and fourth electrodes spaced a second distance apart, and the first distance and the second distance are different.

9. The method of claim 8, wherein the first electrode and the third electrode are located at a same longitudinal position along a longitudinal direction of the tubular stock.

10. The method of claim 1, wherein the heating and drawing are performed such that the tapered end of the tubular device has a length of between about 0.1 mm to about 1.0 mm.

11. The method of claim 10, wherein the heating and drawing are performed such that the tapered end of the tubular device has a length of between about 0.2 mm to about 0.8 mm.

12. The method of claim 1, wherein the tubular stock is about 10 gauge to about 40 gauge and has a substantially cylindrical shape.

13. The method of claim 12, wherein the tubular stock is about 34 gauge to about 40 gauge.

14. The method of claim 1, wherein a diameter of a smaller end of the tapered end is between about 40% and about 90% the diameter of a non-tapered portion of the tubular device.

15. The method of claim 1, wherein the tubular stock is electrically conductive.

16. The method of claim 1, wherein the tubular stock is stainless steel.

17. The method of claim 1, wherein the tubular stock is heated to within 10% of its annealing temperature.

18. The method of claim 1, wherein the tubular stock is heated to a maximum temperature lower than a melting temperature of the tubular stock.

19. The method of claim 1, wherein the heating and drawing are performed such that an outer portion of the tubular stock at the softened section stretches plastically immediately prior to an inner portion of the tubular stock at the softened section breaking and separating the workpiece portion from the remaining portion to form the tubular device.

20. A method of producing a pointed cannula, comprising:

providing a tubular stock having an axial passage;

heating the tubular stock at a first heating location to form a softened section, the softened section separating a workpiece portion of the tubular stock from a remaining portion of the tubular stock;

heating the tubular stock at a second heating location, the second heating location being offset from the first heating location along a longitudinal direction of the tubular stock;

drawing the workpiece portion away from the remaining portion to elongate the softened section and separate the workpiece portion from the remaining portion to form the tubular device, wherein the drawing separates the workpiece portion from the remaining portion at a beveled angle of between about 10° to about 45° with respect to a longitudinal axis of the tubular stock, and;

grinding the beveled end of the workpiece wherein said grinding produces at least one sharpened bevel.

21. The method of claim 20, wherein the beveled end of the workpiece has two ground bevels.

22. The method of claim 20, wherein the beveled end of the workpiece has at least 3 ground bevels.

23. The method of claim 20, wherein the tubular stock is about 34 gauge to about 40 gauge.

* * * * *